US006482103B1

(12) United States Patent
Vache

(10) Patent No.: US 6,482,103 B1
(45) Date of Patent: Nov. 19, 2002

(54) GOLF CLUB SUPPORT

(76) Inventor: Raymond E. Vache, 605 Sheffield Dr., Richardson, TX (US) 75081

( * ) Notice: Subject to any disclaimer, the term of this patent is extended or adjusted under 35 U.S.C. 154(b) by 0 days.

(21) Appl. No.: 09/519,182

(22) Filed: Mar. 6, 2000

Related U.S. Application Data

(60) Provisional application No. 60/122,906, filed on Mar. 5, 1999, and provisional application No. 60/122,907, filed on Mar. 5, 1999.

(51) Int. Cl.[7] ..... A63B 55/10

(52) U.S. Cl. ..... 473/282; 248/520

(58) Field of Search ..... 473/282, 286; 248/156, 530, 511, 520, 514, 371, 188, 415, 418

(56) References Cited

U.S. PATENT DOCUMENTS

| | | | | |
|---|---|---|---|---|
| 4,805,911 | A | | 2/1989 | Ferlazzo et al. |
| 5,532,766 | A | * | 7/1996 | Mateer |
| 5,782,443 | A | * | 7/1998 | La Fontaine |
| 5,815,886 | A | * | 10/1998 | Nishio |
| 6,005,767 | A | * | 12/1999 | Ku |
| 6,159,107 | A | | 12/2000 | Walton |

* cited by examiner

*Primary Examiner*—Stephen Blau
(74) *Attorney, Agent, or Firm*—Marc A. Hubbard; Munsch Hardt Kopf & Harr, P.C.

(57) ABSTRACT

An assembly for propping a golf club so that its grip remains elevated above the ground is installed in the end of a golf club. The assembly telescopes in and out of a retainer that fits within a vent hole in a golf club grip. The assembly is stowed during play and is extended and pivoted to elevate the grip-end of the club. The prop and retainer are keyed to prevent relative rotation.

15 Claims, 17 Drawing Sheets

SECTION B-B

GOLF CLUB SUPPORT

This application claims priority from U.S. provisional applications Nos. 60/122,906 and 60/122,907, both filed Mar. 5, 1999.

FIELD OF INVENTION

The invention pertains generally to golf clubs.

BACKGROUND OF THE INVENTION

The widespread use of battery-powered carts in the game of golf has created a problem for players. When making an approach shot to the green, a golfer must leave a cart usually on a paved path and carry two clubs to the ball. One for the approach shot and a second for putting. When playing in the morning, the grass is usually wet with dew. After the golfer lays the unused club on the ground, he must then dry the grip with a towel before using the club at the next shot.

It has been suggested that a retractable prop can be stowed within the handle of a golf club by inserting it through the vent hole the present on most golf club grips. When the golf club is used for a shot, a prop is retracted inside the club grip. Before laying the club on the ground, the prop is pulled out to reveal a leg mounted to a hinge. The prop is then rotated 90 degrees to the club shaft and turned 90 degrees axially to the club head face.

SUMMARY OF THE INVENTION

According to the invention, certain improvements are made to a retractable prop that is installed into a vent hole of a golf club grip that improves its function and manufacture.

In accordance with various aspects of the invention, a hinged prop that extends through a support retainer installed in a vent hole of a golf club grip resists rotation within the support retainer to provide greater stability, and further resists extension when retracted to prevent or reduce the possibility of unintended extension when the club is in a bag. To facilitate insertion, the retainer is tapered, and includes a barb for resisting unintentional removal from a grip vent hole in which it is installed.

In one preferred embodiment, support retainer and a hinged leg are formed of two members joined by a hinge. The support retainer has a tapered section for insertion of a barb, land and flange that act to hold the support retainer as a cap of a golf club grip. The retainer also includes a latch for cooperating with grooves formed on the hinged leg to prevent unwanted extension or retraction of the leg. The first member of the leg includes a female half of a hinge at one end and conical tip at the other. The conical tip forms, in effect, an extension of the tapered section of the support retainer for facilitating insertion of the prop into a vent hole of the golf club grip. The conical member also acts as a stop during extension of the leg. The second leg member, referred to as a support leg, has a male half of the hinge at one end and a pod at the other. It includes molded bosses which function as a hinge pin and a tang for cooperating with detents formed in the female half of the hinge to hold the hinge in one of two positions: one in which the prop leg is rotated into a support position and the other one in which it is aligned with the first part of the leg for insertion into the support retainer. The leg has a truncated circular cross-section to prevent axial rotation with respect to the support retainer.

The preferred embodiment may be assembled from three thermoplastic injection moldable parts, made of lightweight material that can be snapped together, resulting in low cost manufacture. The result is an unobtrusive installation inside the club grip, prop leg position stability under a variety of terrain conditions, and a resistance to unwanted extension of the prop leg from a retracted or stowed position.

DETAILED DESCRIPTION OF PREFERRED EMBODIMENTS

Figure 1:
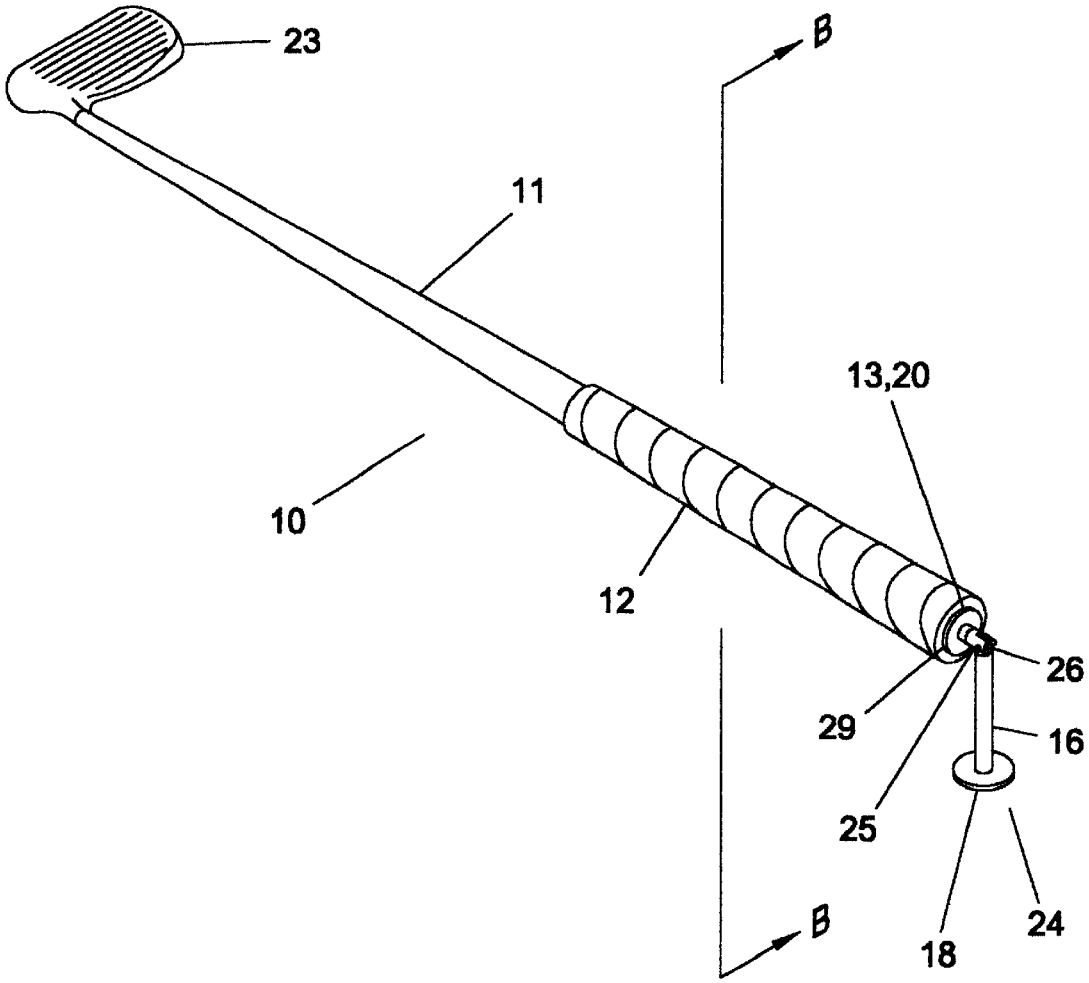
FIG. 1 is a perspective view of a golf club having a first embodiment of a prop assembly.

Referring to FIGS. 1–8, a golf club has a shaft 11, head 23 and a golf club prop assembly 10 installed in a vent hole 13 of grip 12 in a supporting position. In FIG. 1, the prop assembly 10 is in an extended position to prop up the golf club shaft 11 and thereby keeps the grip 12 of the club above the ground, clean and dry. The support assembly may be made of any rigid material construction. A stop tube, hinge and support tube subassembly 14, and support pad 18 extends outwardly from the expandable grip vent hole. A hinged prop leg 24 is extended and rotated 90 degrees downward. It is also rotated axially at a right angle to the club head 23 when supporting the golf club. This is required for balancing the golf club handle 11 on the prop leg 24. A support pad 18 rests against the playing surface or ground.

Figure 2:
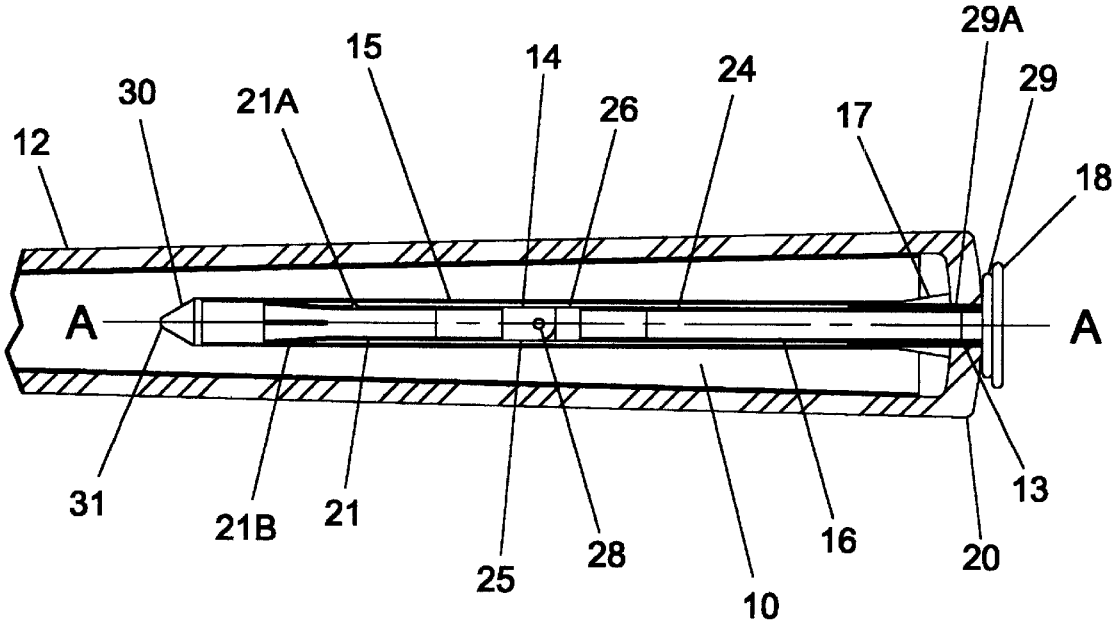
FIG. 2 is a sectional side view of the first embodiment of the golf club prop assembly of FIG. 1.

During play, golf club support assembly 10 is stowed in the club grip 12 with a stop tube, hinges and support tube subassembly 14 telescoped inside a housing tube 15, as shown in FIG. 2. This figure illustrates the housing tube 15 having a longitudinal axis A—A aligned with the longitudinal axis of the handle and secured within the club grip 12. The longitudinal axis of the stop tube, hinge and support tube subassembly 14 also align with axis A—A. A stop tube 21, hinge 25, 26 and support tube 16 all telescope inside the housing tube 15 for storage inside the grip.

The tubes may be nickel-plated, thin-wall brass or any suitable compositions which are designed to have sliding friction sufficient to maintain either a stowed or extended position. Position friction is required to prevent unwanted extension of the prop leg 24 when the golf club is placed grip first into a golf bag. This design feature is described fully in a subsequent paragraph. A retention support or barb 17 urges against a grip end cap 20 with sufficient compressive force so that unintentional removal of the golf prop assembly 10 is difficult.

The method of installing the golf club support assembly 10 to retrofit an existing club with a rubber or comparable composition end cap 20 having a vent hole 13 expandable from a relaxed position to a expanded position begins by inserting a conical tip 30 of the housing tube 15 into the vent hole 13. The outside diameter of the housing tube 15 is larger than the diameter of the expandable vent hole when the vent hole is in its relaxed position. The conical tip 30 has a spherical point 31 which has a smaller diameter than the relaxed vent hole diameter enabling the housing tube 15 to begin to enter the hole 13. The vent hole mast stretch to accept the housing tube 15 as it is urged into the hole 13. The housing tube is pushed into the expanding vent hole and through the hollow handle until the tapering support reteriner 17 reaches the hole opening. When the apex of the barb taper passes trough the vent hole 13, the golf prop assembly 10 is retained since the grip end cap 21 is positioned between the flat shoulder position of the support retainer 17 and the retention flange 29 while resting on the flange land 29A. The vent hole 13 has been stretched to the maximum and then contacts to the second expanded position.

Figure 3:
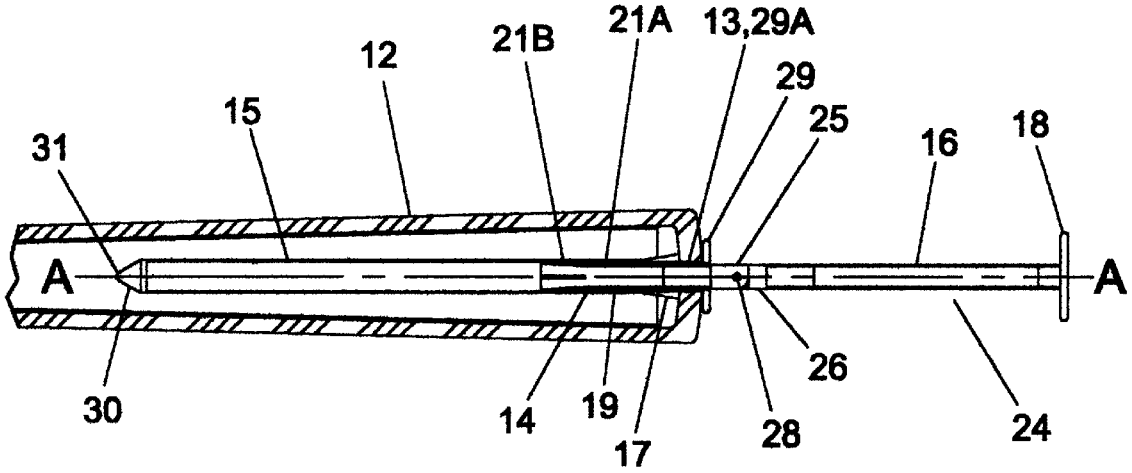
FIG. 3 is a sectional side view of the golf club support assembly of FIG. 1.
Figure 4:
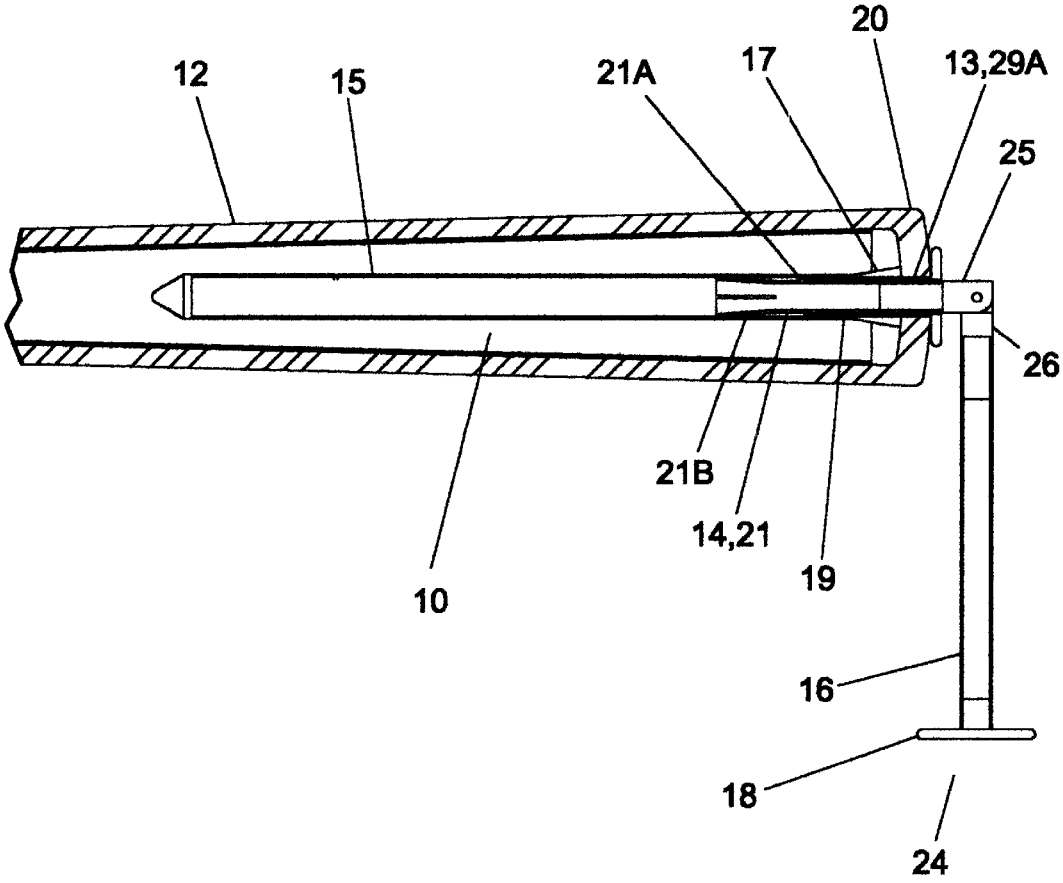
FIG. 4 is a sectional side view of a golf prop assembly of FIG. 1 with a support leg rotated ninety degrees downward which would be in preparation of the club being laid on the ground.

The golf club support assembly 10 the support leg 16 and hinges 25, 26 are shown in FIG. 3 in an extended position, as pulled out by the golfer. The figure shows the prop leg 24 extended from within the grip 12. The support pad 18 is larger in diameter than the retaining flange 29 which allows a finger-nail grip necessary to extend the prop leg 24. As shown in FIG. 4, after extended, support leg 24 is rotated 90 degrees downward which would be in preparation of the club being laid on the ground.

To provide stability for the mono-pod support, experiments indicate that a minimum of 10 inch-ounces of axial torque resistance about longitudinal axis A—A must exist between the rotated prop leg and the club grip. Resistance to rotation allows the club grip to remain supported even if the club is laid on an inclined or uneven surface or the prop leg is not oriented perfectly vertical. Grooves 21C are formed in a stop tube 21, and support tube 16. Grooves are also machined in the female hinge 25 and male hinge 26. When the parts of the stop tube assembly 14 are aligned, the groove also aligns and provides an anti-rotation track when sliding through a keying tube 19 shown in FIG. 6. Keying tube 19 has a formed groove 19A which mates to the grooves of the stop tube assembly 14, and prevent axial rotation as the prop leg 24 is stowed or extended. Prop leg 24 must be turned axially 90 degrees to the club head 23. Since the sliding parts of the prop are keyed to the stationary subassembly, the entire assembly must turn within the vent hole. Friction between the grip vent hole sides 13 and the retaining flange land 29A is low enough to allow the prop to rotate but sufficiently higher than the 10 inch-ounces necessary to provide stability.

The prop leg and hinge subassembly 14 must have enough sliding friction relative to the stationary housing tube 15 to prevent unwanted prop leg extension when the golf club is returned to the carrying bag with the grip pointed downward. Friction leaf section 21B is included at the end of the stop tube 21. The tube walls are split in four equal sections and the ends expanded to approximately 0.30 inch in diameter. The expanded end of the stop tube is now four leaf springs which in the free state are larger than the inside diameter of the housing tube 15. The frictional force of the compressed sections against the inside wall of the housing tube 15 provides a constant resistance to free sliding of the prop leg 24. Extension force resulting from the expanded friction leaf sections is approximately 12 ounces.

When the prop leg 24 is extended and rotated 90 degrees, a detent in the form of a spring-loaded ball 27 mates to the support detent 26B of the male hinge to limit free rotation as a means of constraint in the downward position to adequately support the club. As shown best in FIG. 5, the detent includes a detent spring 22, detent ball 27 and a stow detent 26A and support detent 26B of the male hinge 26. The detent spring 22 and the detent ball 27 are mounted in an axial hole of the female hinge 25. When the male hinge 26 is mated to the female hinge and retained by a rivet 28, the detent ball 27 engages either male hinge detents depending on the orientation of the prop leg 24. Torque required to overcome the detents is approximately 1.3 inch-ounces or a force of 0.50 ounce at the support pad 18 normal to the support tube 16. The detents of the male hinge 26 are oriented 90 degrees apart. The stow detent 26A is centered on the longitudinal axis of the support tube and aligns with the longitudinal axis of the housing tube 15. This detent position permits quick insertion of the support shaft 16 into the keying tube 19. The support detent 26B is oriented 90 degrees to the support tube longitudinal axis and is centered on the rivet hole of the male hinge 26.

Figure 5:
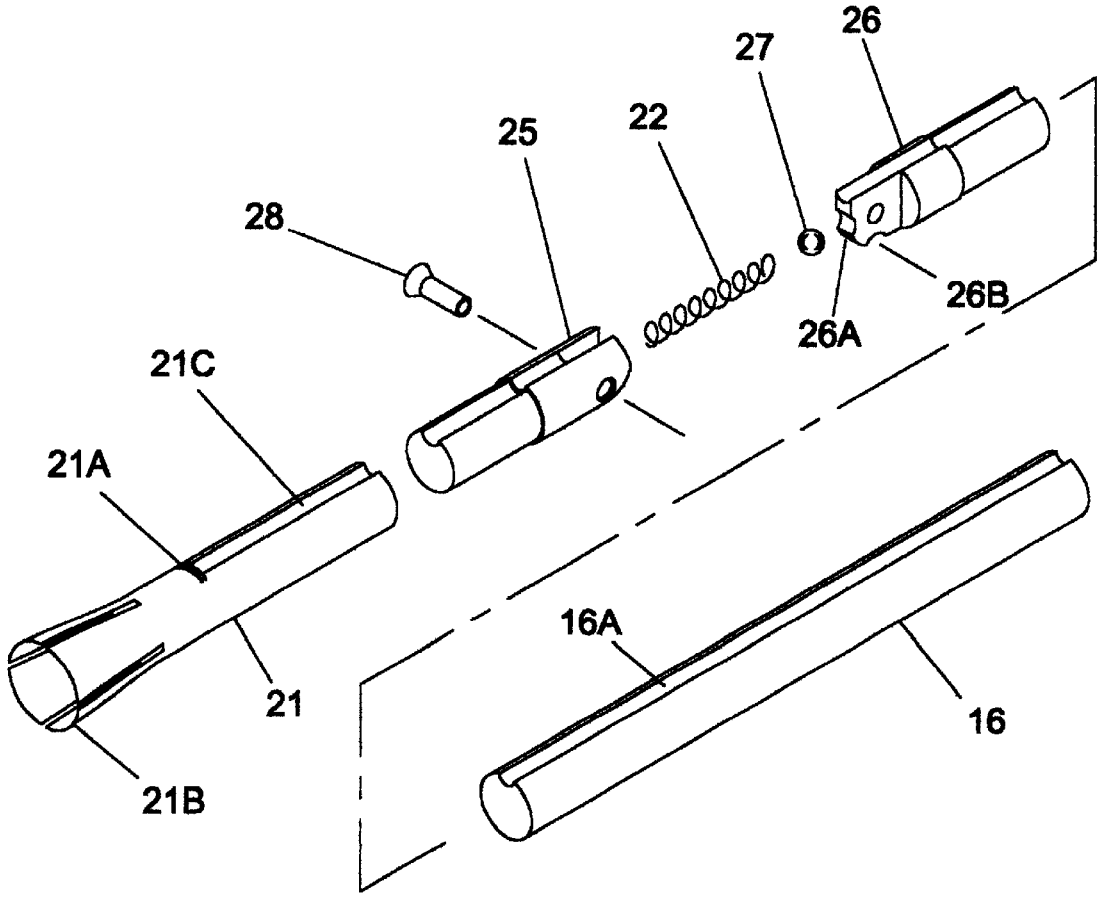
FIG. 5 is an exploded view of certain components of the golf club prop assembly of FIG. 1.
Figure 6:
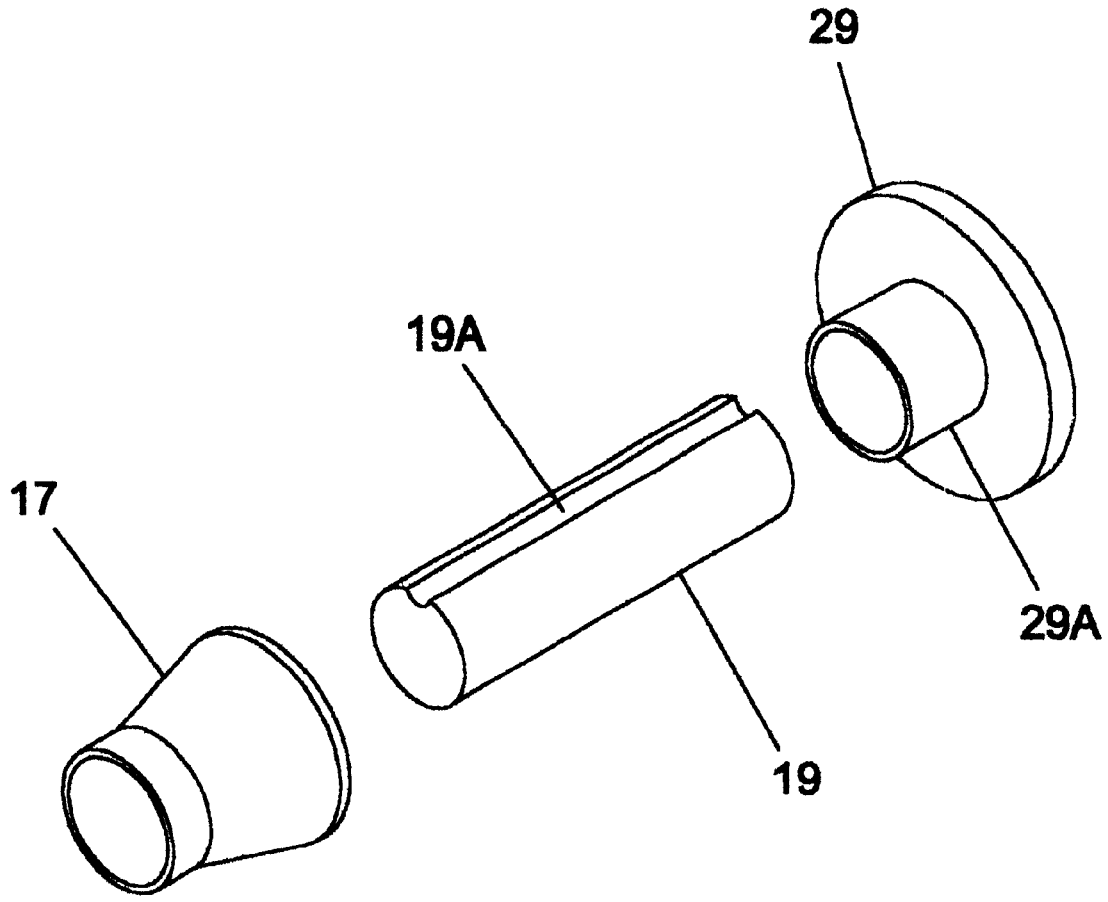
FIG. 6 is an exploded view of certain components of the golf club support assembly of FIG. 1.
Figure 7:
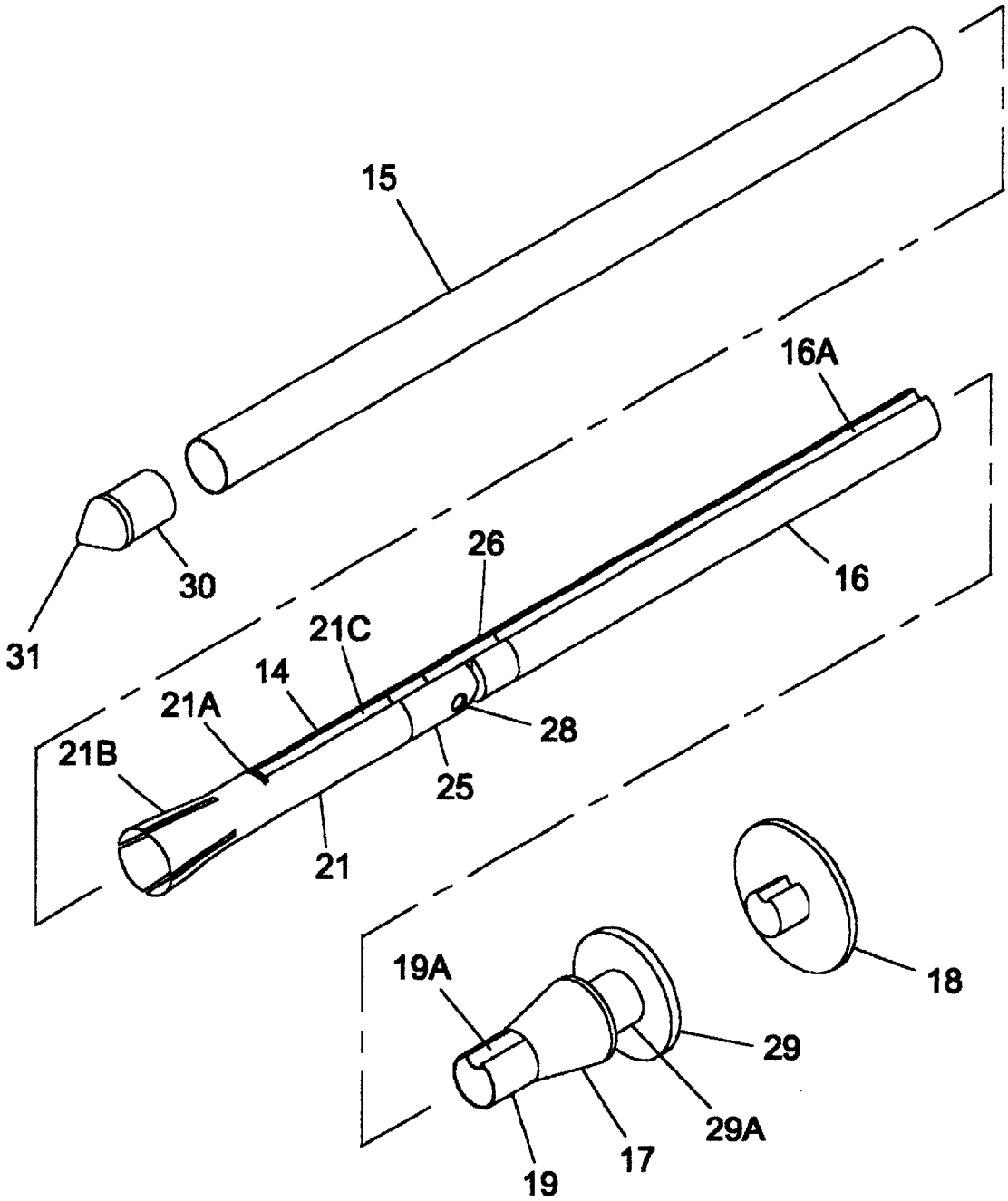
FIG. 7 is an exploded view of the golf club assembly prop of FIG. 1.
Figure 8:
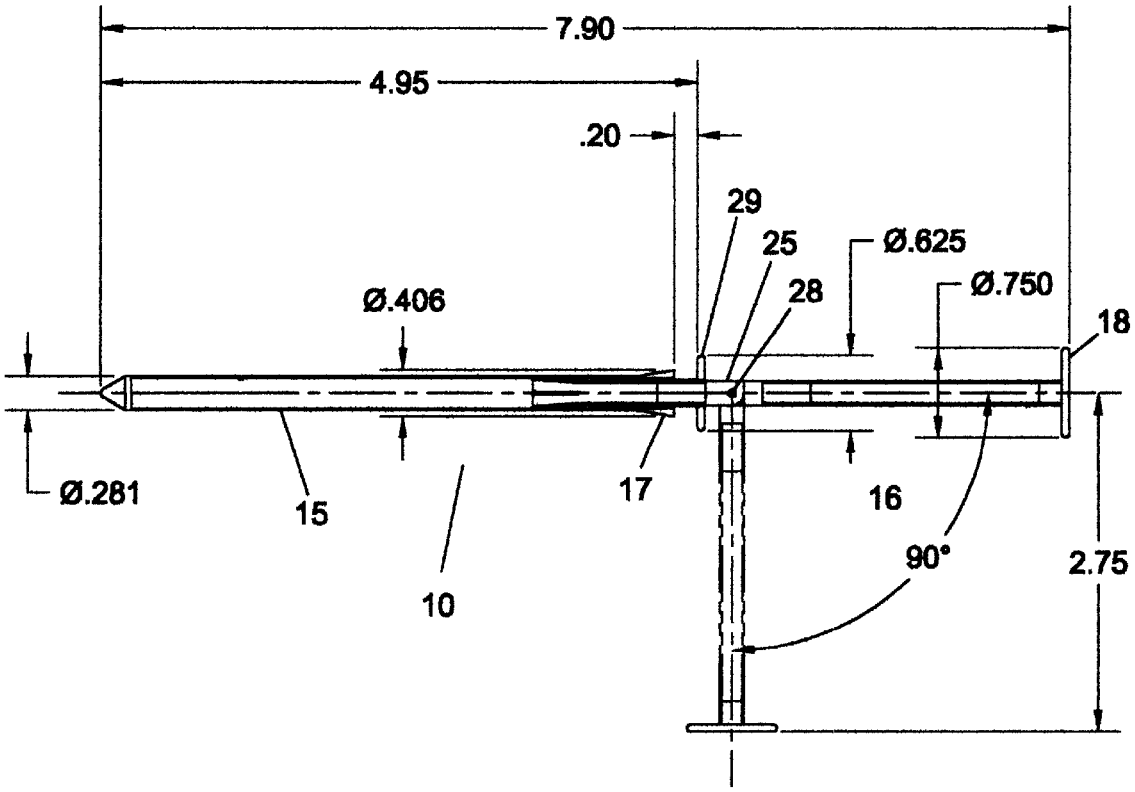
FIG. 8 is a side view of the golf club prop assembly of FIG. 1.

The prop leg 24, stop tube, hinge and support tube subassembly 14 are retained on stationary barb 17, retaining flange 29 and keying tube 19 by means of a tang or protrusion in the side of the stop tube. FIG. 5 shows a stop tang 21A located on the wall of the stop tube 21. The tang protrudes 0.015 inch above the stop tube outside diameter. When the prop leg 24 is extended, the stop tube 21 slides through the keying tube 19. The extended position is controlled by the stop tang 21. A butting to the end of the keying tube 19 thereby retaining the sliding portion of the golf support (FIG. 5) to the fixed section (FIG. 6).

The diameter of each component must be minimized to permit insertion into the grip vent hole. As the parts are sized, the weakest part of the golf prop is the hinge section. The hinge must resist failure when the prop leg 24 and male hinge 26 is forced into the built-in stop of the hinged pair. To achieve the highest possible hinge strength, the material cross-section must be optimized. As the rivet (hinge pin) diameter increases, the hinge material cross-section decreases. Therefore, the rivet diameter is chosen by matching its double shear strength to the tensile strength of the thinnest section of the male hinge 26. The rivet diameter chosen is 0.061 inch.

Figure 9:
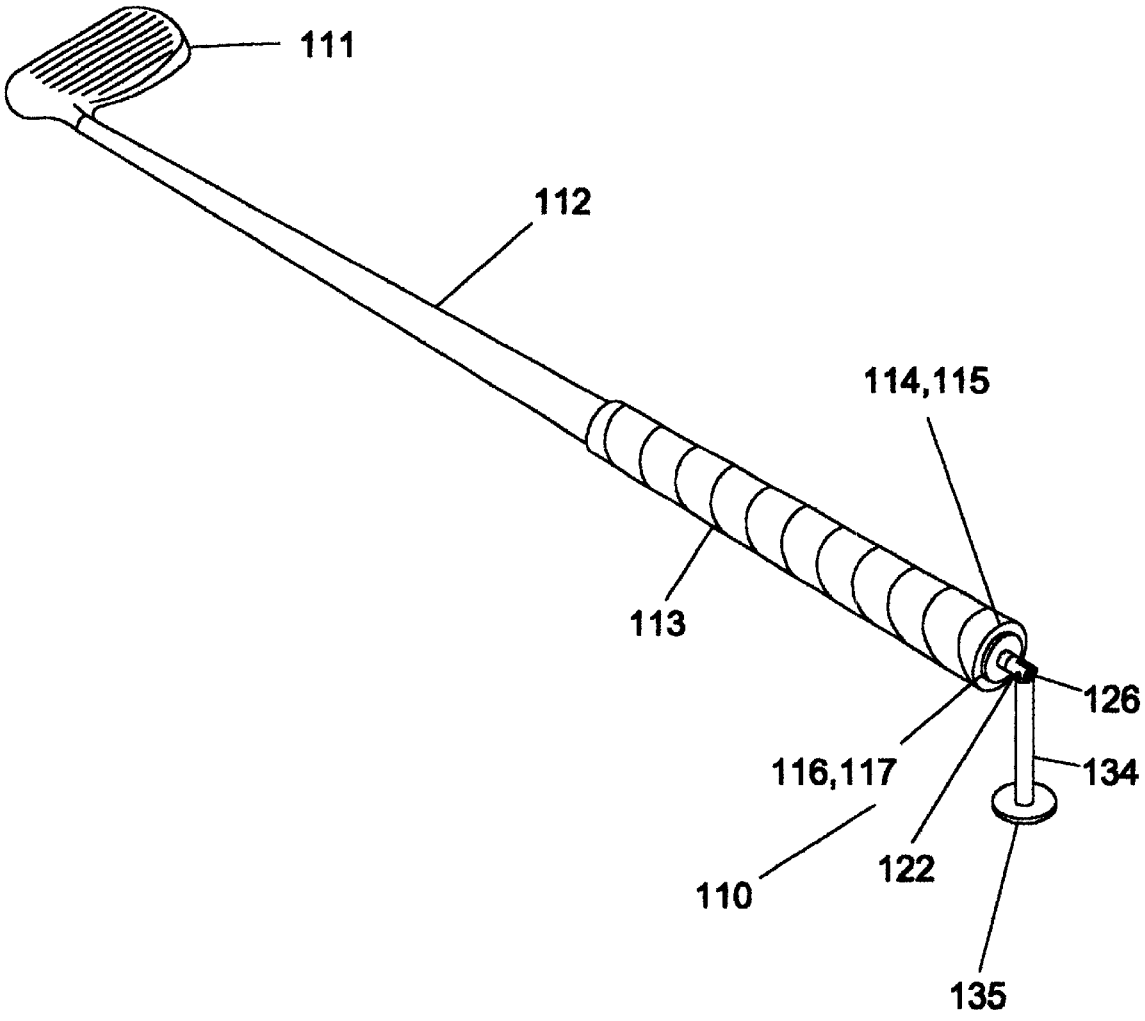
FIG. 9 is a perspective view of a golf club supported above the ground with a second embodiment of a mono-pod golf club prop extended.

Referring to FIG. 9, a golf club includes a shaft 112 and a head 111. A golf club prop assembly 110 is installed in a vent hole 114 of grip 113 of the golf club. The prop assembly is shown in an extended and supporting position to prop the golf club shaft 112 and thereby lift grip 113 above the ground to remain clean and dry. The prop assembly includes a two-piece prop 134 that telescopes in and out of the grip vent hole 114. One piece of the prop is prop leg 134A. Piece 134B remains substantially within the grip even when the prop is extended. It has to be extended clear of the grip, rotated 90 degrees downward, and then also rotated axially at a right angle to the club head 111 when supporting the golf club. A support pad 135 rests against the playing surface or ground.

Figure 10:
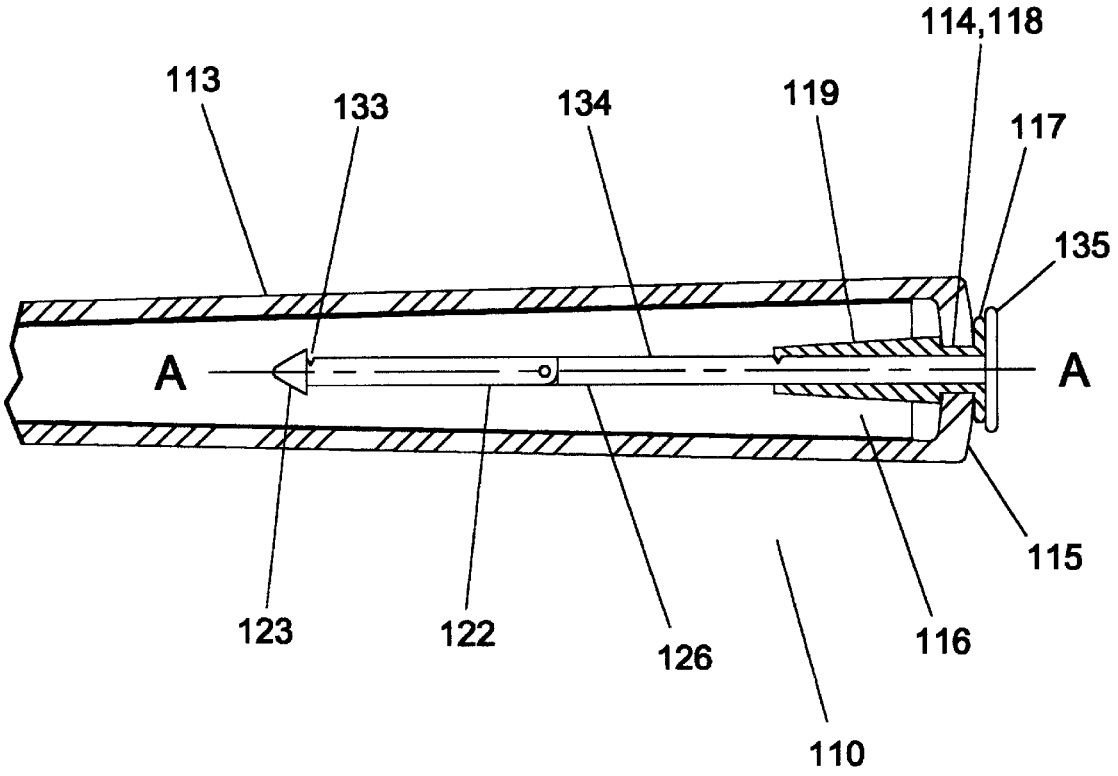
FIG. 10 is a cross-section of a grip of the golf club of FIG. 9, with the leg of the prop retracted.
Figure 11:
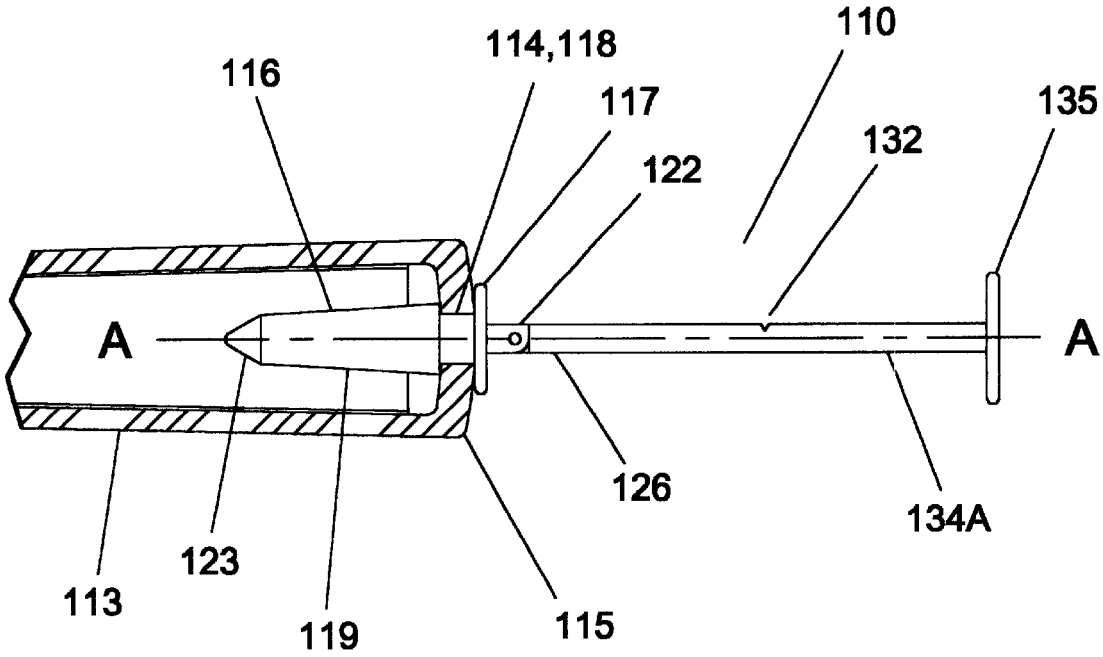
FIG. 11 is a cross-section of the grip of FIG. 10, but with the leg of the prop extended.
Figure 12:
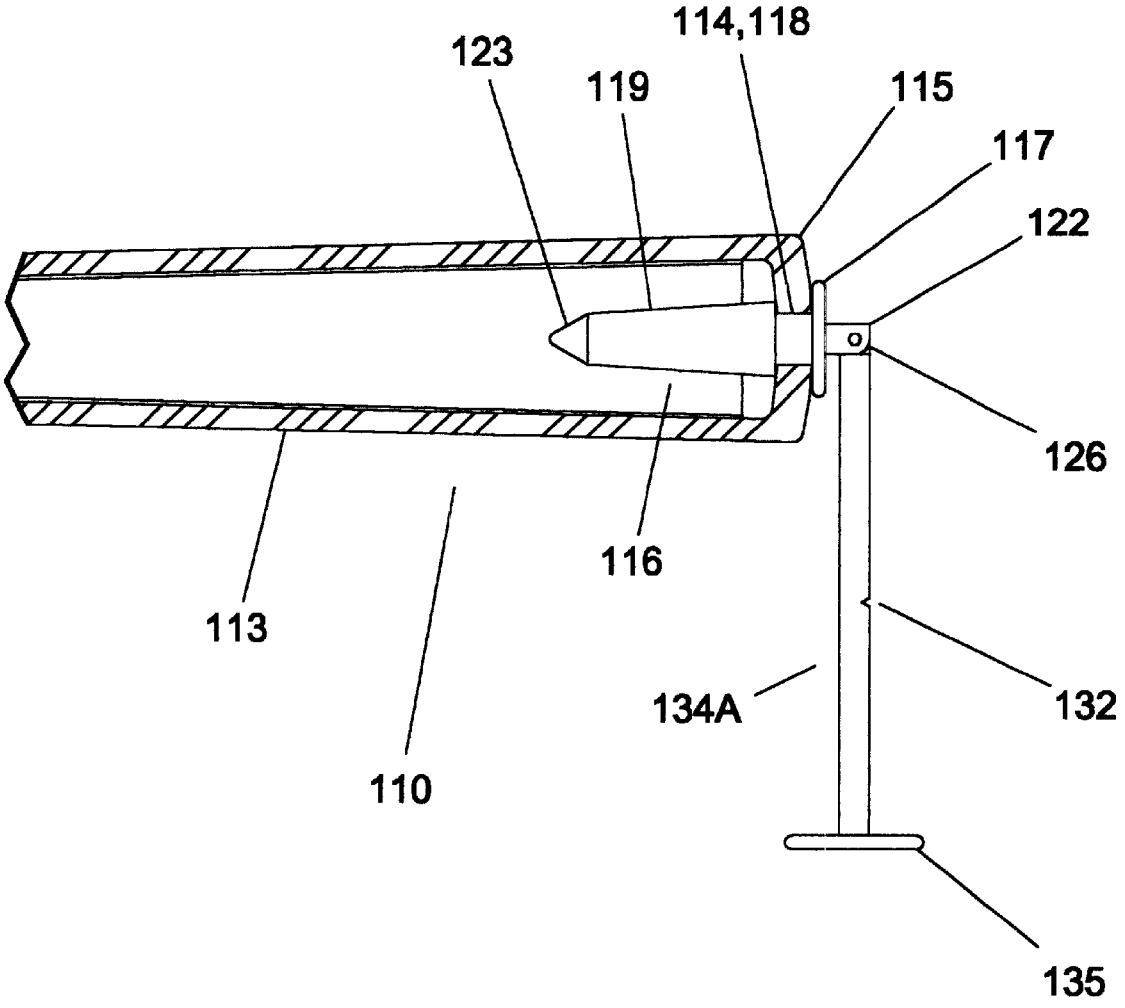
FIG. 12 is a cross-section of the grip of FIG. 10, but with the leg of the prop extended and bent.
Figure 13:
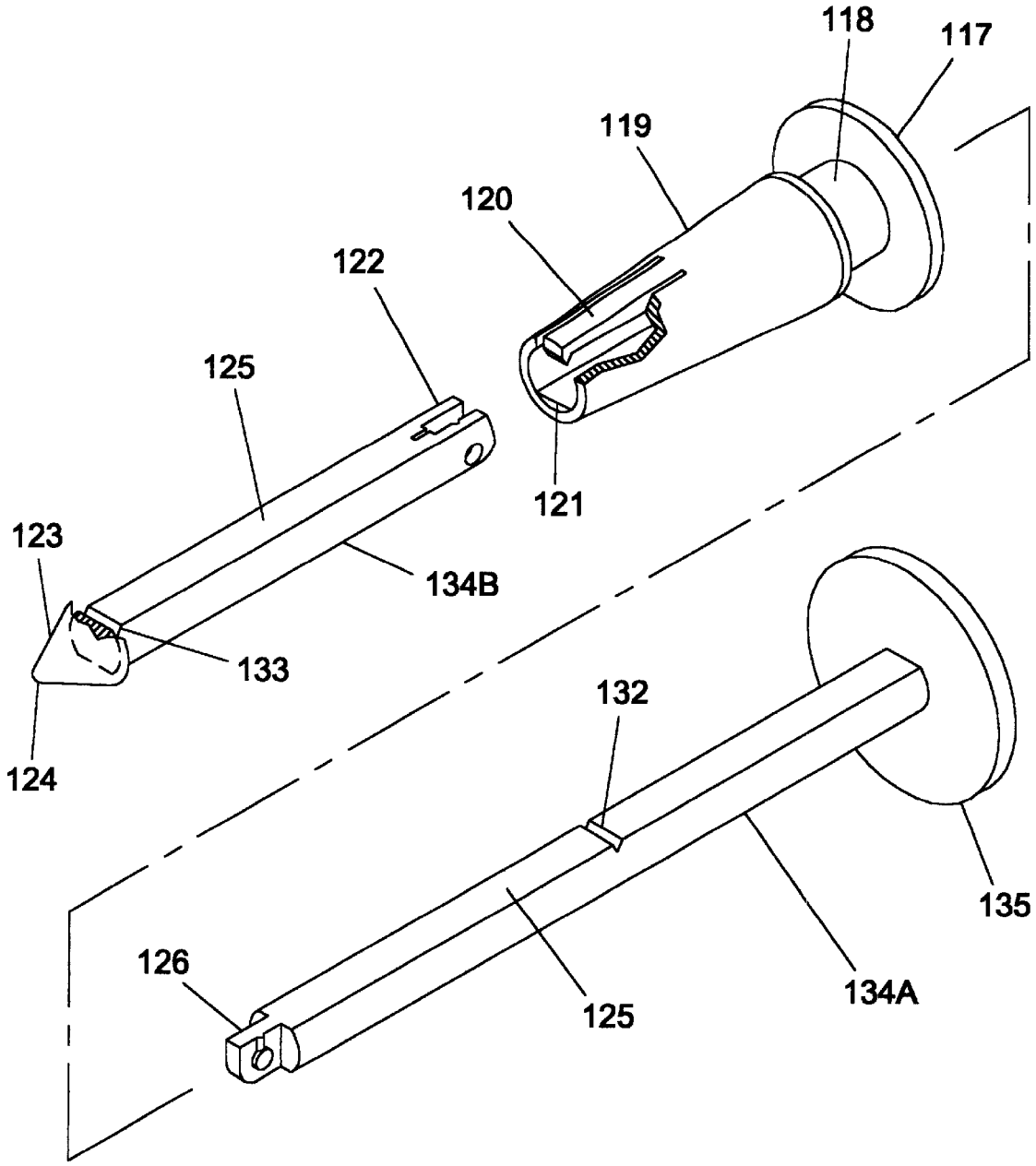
FIG. 13 is an exploded view of the prop assembly of FIG. 10.
Figure 14:
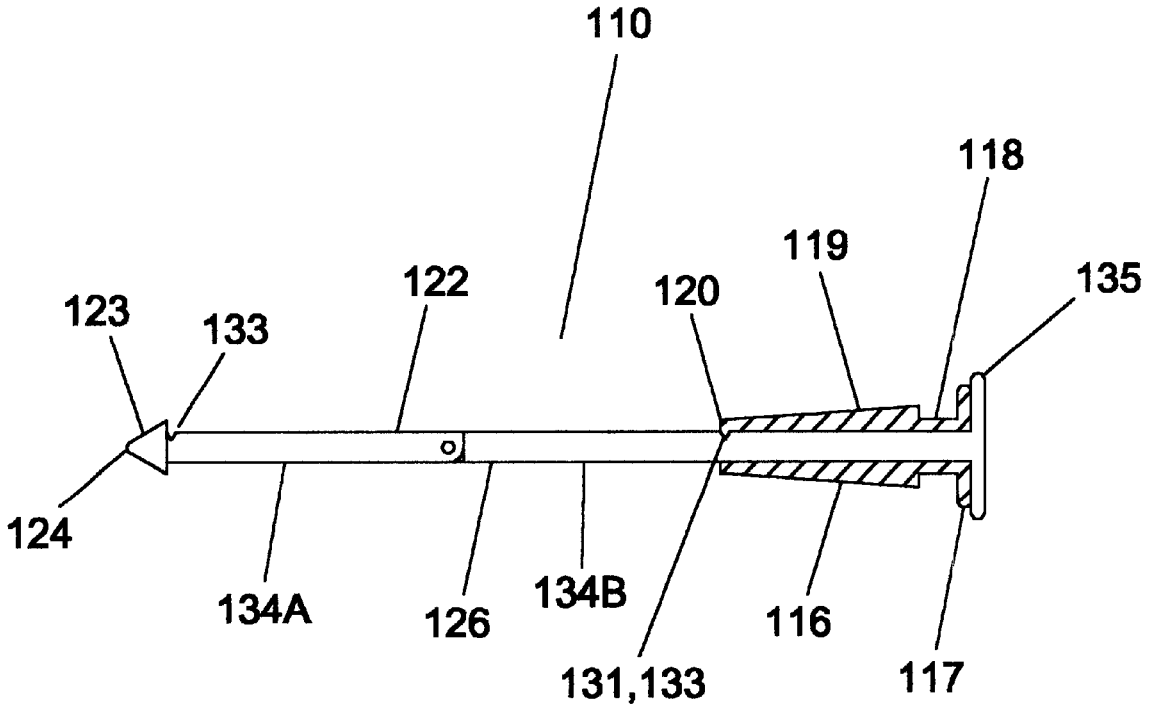
FIG. 14 is a side view, partially sectioned, of the prop assembly of FIG. 10 in a retracted or stowed position.
Figure 15:
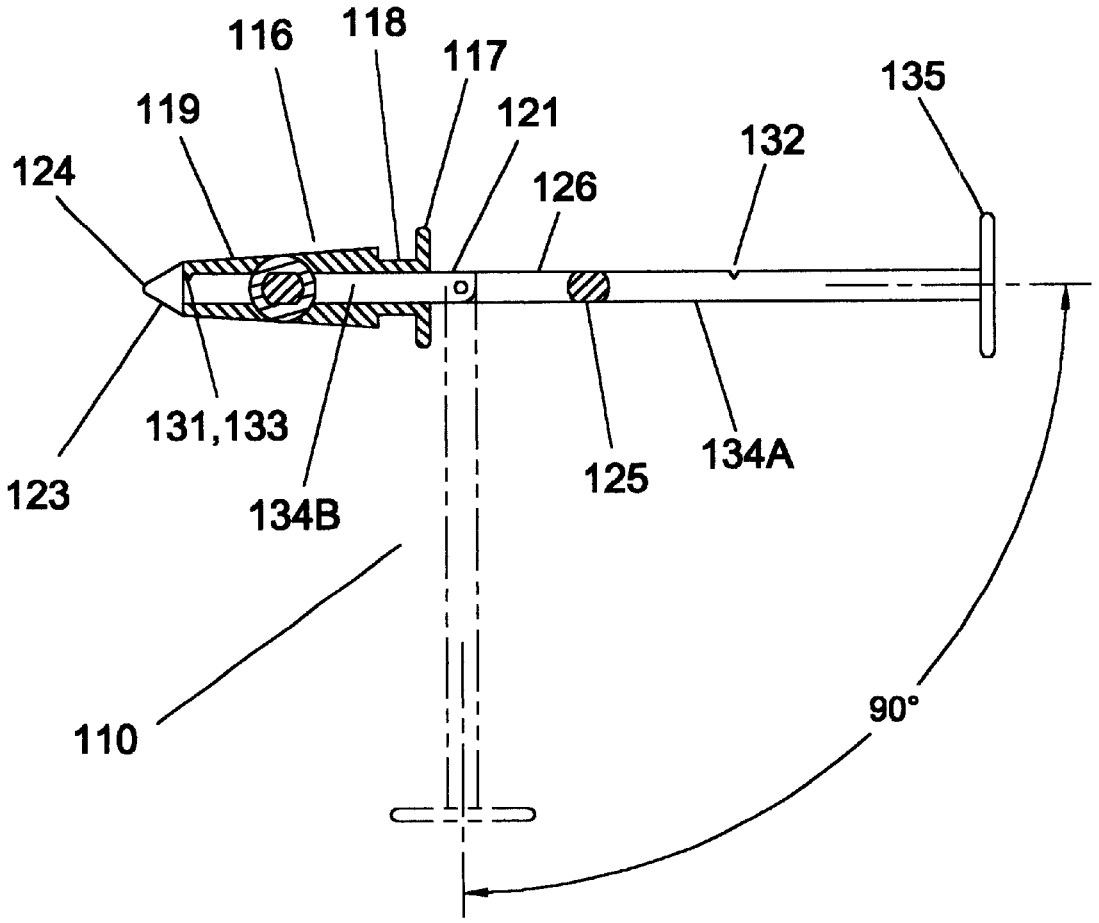
FIG. 15 is a side view, partially sectioned, of the prop assembly of FIG. 10 in an extended position.
Figure 16:
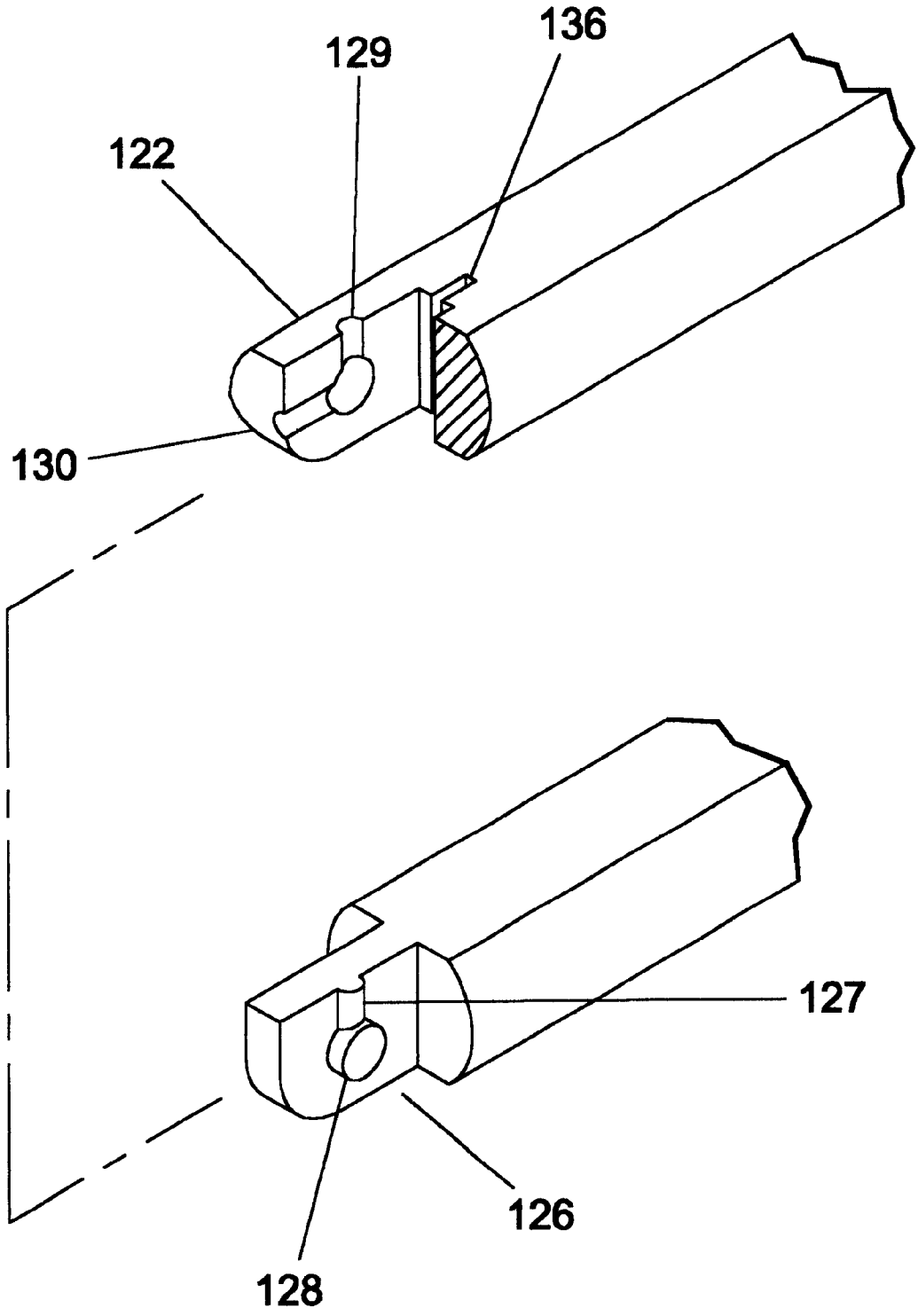
FIG. 16 is a view of a hinge detent and tang detail of the prop assembly of FIG. 10.
Figure 17:
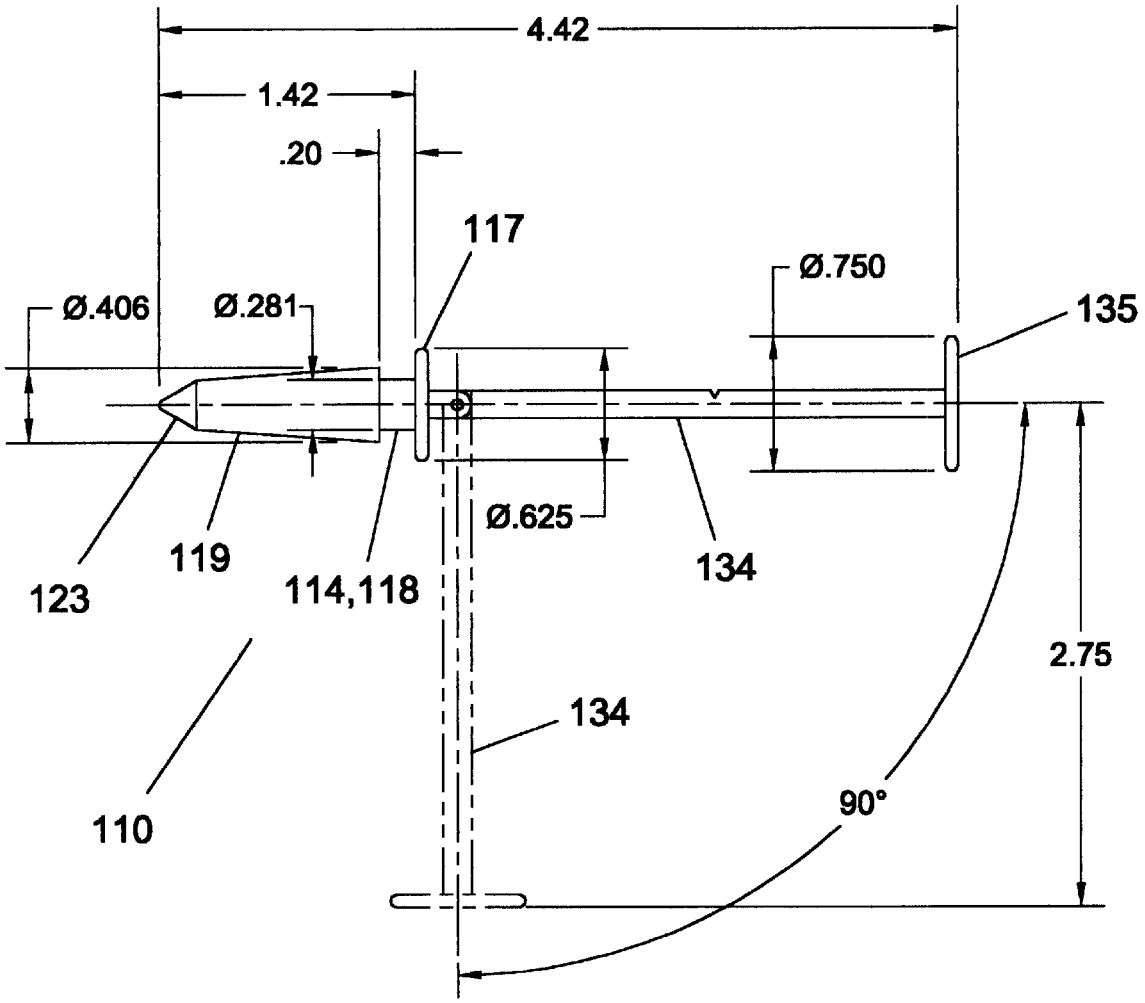
FIG. 17 is a side view of the prop assembly of FIG. 10.

Referring now to FIGS. 10 through 17, golf club support assembly 110 is installed through a cap portion 115 of the club grip 113. In FIG. 10, prop leg 134A is telescoped or retracted through a hole formed in support retainer 116. The support retainer is constrained by a grip end cap 115. The stowed position of the prop in FIG. 10 represents the configuration or position of the prop assembly when the club is used for play.

The prop assembly 110 has a longitudinal axis A—A aligned with the longitudinal axis of the club shaft 112. Conical tip 123 and a hinge comprised of female hinge part 122 and a male hinge part 126 that connect together the two pieces of prop 134, telescope through the support retainer 116 for storage within an open end of the shaft of the club. The longitudinal axis of female hinge 122 and male hinge 126 align with axis A—A. The support retainer 116 includes a tapered barb 119, a retaining flange 117 and a flange land 118 that are inserted in the grip vent hole 114 and retained within the grip 113. The prop leg is shown extended, as when it is pulled out by a golfer. The support pad 135 is larger in diameter than the retaining flange 117 which allows a finger-nail grip necessary to extend the prop leg 134A.

To install the golf club support assembly 110 on an existing club, the grip preferably has a rubber or comparable composition end cap 115 with a vent hole 114. The prop assembly is preferably placed in the extended position shown by FIG. 11. This position mates the conical tip 123 to the tapered retention barb 119, thus making the conical tip an extension of the tapered barb. The conical tip 123 is then inserted into the vent hole 114. The major diameter of the conical tip is larger than the diameter of the expandable vent hole when the vent hole is in its relaxed position. The conical tip 123 has a spherical point 24, which has a smaller diameter than the relaxed vent hole diameter for enabling the conical tip to begin to enter the vent hole 114. The vent hole must stretch to accept the conical tip as it is urged into the vent hole. The prop assembly 110 is pushed into the expanding vent hole and through the hollow shaft 112 and grip 113 until the tapered retention barb 119 reaches the hole opening. When the apex of the barb taper passes through the vent hole 114, the golf prop assembly 110 is retained since the grip end cap 115 is, at this point, positioned between the flat shoulder position of the barb 119 and the retaining flange 117 while resting on the flange land 118. The vent hole 114 has been stretched to pass the barb, then contracts to a second expanded position that places a compression force around the support retainer. The tapered retention barb 119 urges against the grip end cap 115 with sufficient compressive force so that unintentional removal of the golf support assembly 110 is practically impossible.

The mono-pod support design benefits from resistance to rotation about the longitudinal axis A—A (FIG'S 10 and 11). Experiments indicate for good support stability, a minimum of 10 inch-ounces of axial torque must exist between the rotated prop leg and the club grip. Resistance to rotation allows the club grip to remain supported even if the club is laid on an inclined or uneven surface or the leg is not oriented perfectly vertical. To achieve rotational resistance, the prop and the support retainer are keyed to prevent relative rotation. In the illustrated embodiment, this keying is accomplished by truncating the cross section of the prop leg along its entire length to form an anti-rotation flat 125. This flat cooperates with a double-D shaped hole 120 that is formed through the center of the support retainer 116 to prevent relative rotation between the support retainer and the two piece prop.

After the support assembly 110 is installed in the grip end cap 115, the prop leg 134A is axially rotated about the longitudinal axis so that it can be oriented 90 degrees relative to the club head 111 when pivoted about the hinge. Since the sliding parts are keyed to the support retainer 116, the entire assembly must turn within the vent hole 114. Friction between the grip vent hole and the retaining flange land 118 is low enough to allow the support assembly 110 to rotate but sufficiently higher than that necessary to provide stability.

The prop leg 134A includes a means of sliding retention relative to the support retainer 16 to prevent unwanted prop leg extension when the golf club is returned to the carrying bag with the grip pointed downward. In the preferred embodiment, this means is a latch 120. This latch may be integrally formed as part of the tapered retention barb 19 to reduce the number of parts. The latch length and width is selected to result in a moment arm force of 6 ounces when the latch tooth 131 is deflected 0.031 inches. The flexural modulus of ABS plastic is also a factor in the spring rate of the latch. The latch tooth 131 engages stow detent V-groove 132 formed in prop leg 134A, or the extension detent V-groove 133 of the prop piece 134B. The latch 120 is thus designed to retain the prop leg in either the extended or stowed position with a break-away force of approximately 12 ounces.

To facilitate assembly of the three-piece support, bosses 128 are molded on each side of the male hinge 126. The halves of the female hinge 122 are expanded and the male hinge 126 is inserted and the bosses aligned with hinge holes formed on the female hinge. Upon contraction, the female hinge 122 retains the male hinge 126 and the assembly is complete. The length of the bosses 28 is sized so that the expansion of the female hinge halves does not exceed the flexural strength of the plastic material.

When the prop is extended and prop leg 134A rotated 90 degrees, it preferably has means of constraint in the downward position to adequately support the club. In the preferred embodiment, male hinge 126 has a detent tang 127 oriented 90 degrees to the club longitudinal axis A—A. The detent tang 127 mates with a support detent groove 130 of the female hinge 122. This orientation provides stability of the prop leg 134A when the club is laid on the ground. A stow detent groove 129 is parallel to the club longitudinal axis and is used to align the male hinge 126 with the female hinge 122 to permit the hinge pair to telescope inside the support retainer 116. In either detent position the prop leg 134A must overcome the frictional force of the tang 127 exiting the respective groove 129 or 130. The flexural modulus of the plastic material provides a normal force and causes the female halves of the hinge 122 to resist rotation of the male hinge 126 out of the detent position. An expansion relief slot 136 is sized to cause a flexural force which results in a rotational momentary torque of approximately 3 inch-ounces. The detent groove depth is shallow enough to prevent the hinge bosses 128 of the male hinge 126 from disengaging the female hinge holes.

The golf club support is preferably also lightweight so its addition to the club is not noticeable to the player. For this reason, all components are molded from acrylonitril butadiene-styrene (ABS) plastic. This material is 8 times lighter than steel or brass and 2.5 times lighter than aluminum. It is also impact resistant and has a relatively high tensile strength (6000 psi).

The invention has been described with reference to preferred embodiments. Alterations, substitutions and omissions to the preferred embodiment may be made without departing from the scope of the claims, which are set forth below.

What is claimed is:

1. A golf club support assembly comprising:

an elongated prop having an axis extending along its length, the prop including a hinge for permiting a first part of the prop to articulate with respect to a second part of the prop;

a support retainer having defined through it a center hole, through which the prop telescopes between a retracted position and an extended position;

the prop having a cross-sectional shape complementary with the hole's shape for preventing unwanted relative rotation when the prop is in at least an extended position;

wherein the prop includes a flat surface extending along its length and the hole has a complementary flat side that cooperates with the flat surface of the prop.

2. The golf club support assembly of claim 1, wherein the support retainer includes first and second spaced apart flanges ortented perpendicular to the support prop.

3. The golf club support assembly of claim 1, further comprising means for resisting extension of the prop when in a retracted position with respect to the support retainer.

4. The golf club support assembly of claim 3, wherein the means for resisting extension includes a deflectable latch.

5. The golf club support assembly of claim 3 wherein the means for resting extension includes an elongated tube in which the prop slides and the prop includes a friction member cooperating with the elongated tube.

6. The golf club support assembly of claim 1, wherein the hinge includes means for preventing unintended rotation on the hinge when the first part of the prop is bent with repect to the second part of the prop.

7. The golf club support assembly of claim 1, further including means for stopping unintended extension of the prop from the support retainer.

8. The golf club support assembly of claim 1 wherein the hinge includes a first half articulating with respect to the second half, the first half being integrally formed on the first part of the prop and the second half being integrally formed on the second part of the prop.

9. The golf club support assembly of claim 8, wherein the hinge includes bosses formed on the first half of the hinge, and complementary holes formed on the second half of the hinge.

10. The golf club support assembly of claim 1 wherein the first and second parts of the prop and the support retainer are formed of injection molded plastic.

11. The golf club support assembly of claim 1, further including a deflectable latch integrally formed with the support retainer that cooperates with a groove formed on the prop for resisting un intentional extension of the prop when retracted.

12. A golf club support assembly comprising:

an elongated prop having an axis extending along its length, the prop including a hinge for permiting a first part of the prop to articulate with respect to a second part of the prop;

a support retainer having defined through it a center hole, through which the prop telescopes between a retracted position and an extended position;

the prop having a cross-sectional shape complementary with the hole's shape for preventing unwanted relative rotation when the prop is in at least an extended position;

wherein the hinge includes a detent arranged for preventing unintended rotation of the hinge when the first part of the prop is bent with respect to the second part of the prop.

13. The golf club support assembly of claim 12, wherein the one of the cross-sectional shape of the prop and the shape of the hole in the support retainer includes a key and the other of the cross-sectional shape of the prop and the hole in the support retainer includes a complementary groove.

14. The golf club support assembly of claim 12, wherein the detent includes a rang integrally formed on either a first or a second part of the hinge cooperating with a groove integrally formed on the other of the first or second part of the hinge.

15. A golf club support assembly comprising:

an elongated prop having an axis extending along its length, the prop including a hinge for permiting a first part of the prop to articulate with respect to a second part of the prop;

a support retainer having defined through it a center hole, through which the prop telescopes between a retracted position and an extended position;

the prop having a cross-sectional shape complementary with the hole's shape for preventing unwanted relative rotation when the prop is in at least an extended position;

wherein the support retainer includes a tapered barb, a rataining flage and a flange land;

wherein the prop includes, at one terminating end, a stop of conical shape that mates with the tapered barb of the support retainer.

* * * * *